US006619386B2

(12) United States Patent
Iino et al.

(10) Patent No.: US 6,619,386 B2
(45) Date of Patent: Sep. 16, 2003

(54) STACKED-TYPE, MULTI-FLOW HEAT EXCHANGER

(75) Inventors: Yuusuke Iino, Isesaki (JP); Tooru Yamaguchi, Isesaki (JP); Shigeru Okada, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/083,581

(22) Filed: Feb. 27, 2002

(65) Prior Publication Data

US 2002/0125003 A1 Sep. 12, 2002

(30) Foreign Application Priority Data

Mar. 9, 2001 (JP) ..... P2001-066890

(51) Int. Cl.[7] ..... F28F 9/02; F28D 7/06; B21D 51/38

(52) U.S. Cl. ..... 165/173; 165/176; 29/890.052

(58) Field of Search ..... 165/173, 67, 176, 165/147; 29/890.052

(56) References Cited

U.S. PATENT DOCUMENTS 5,082,051 A * 1/1992 Ando ..... 165/173
5,127,466 A 7/1992 Ando
5,325,914 A 7/1994 Tanaka
5,348,079 A 9/1994 Tanaka
5,785,119 A 7/1998 Watanabe et al.
5,868,196 A 2/1999 Tanaka
5,975,197 A 11/1999 Kado
6,035,931 A 3/2000 Kado et al.
6,289,979 B1 * 9/2001 Kato ..... 165/173

FOREIGN PATENT DOCUMENTS

JP 07301472 A * 5/1994
JP 09280780 A * 10/1997
JP 410290091 * 10/1998
JP 11083377 3/1999

* cited by examiner

*Primary Examiner*—Henry Bennett
*Assistant Examiner*—Tho V Duong

(57) ABSTRACT

A stacked-type, multi-flow heat exchanger includes a first header pipe and a second header pipe formed opposite the first header pipe. The heat exchanger also includes a plurality of heat transfer tubes extending between the first header pipe and the second header pipe, such that the first header pipe and the second header pipe are in fluid communication via the heat transfer tubes. The heat exchanger further includes a plurality of fins alternately stacked with the plurality of heat transfer tubes. Moreover each of the ends of the first header pipe includes a first tapered portion having a reduced diameter relative to a diameter of a center portion of the first header pipe. In another embodiment, each of the ends of the second header pipe includes a second tapered portion having a reduced diameter relative to a diameter of a center portion of the second header pipe.

3 Claims, 8 Drawing Sheets

STACKED-TYPE, MULTI-FLOW HEAT EXCHANGER

BACKGROUND OF THE INVENTION

1. Field of the Invention

The invention relates generally to stacked-type, multi-flow heat exchangers. More specifically, the invention relates to stacked-type, multi-flow heat exchangers for use in an air conditioning system of a vehicle.

2. Description of Related Art

Referring to FIG. 1, a known stacked-type, multi-flow heat exchanger 70 may comprise a first header pipe 71 and a second header pipe 72 formed opposite first header pipe 71. Heat exchanger 70 also may comprise a plurality of heat transfer tubes 73 extending between first header pipe 71 and second header pipe 72, such that first header pipe 71 and second header pipe 72 are in fluid communication via heat transfer tubes 73. Heat exchanger 70 further may comprise a plurality of corrugated fins 74, which are alternately stacked with heat transfer tubes 73.

Referring to FIG. 2, an enlarged, cross-sectional view of a portion (A) of heat exchanger 70 is depicted. In heat exchanger 70, each end of first header pipe 71 comprises a disk-shaped plug member 75 positioned inside an opening formed in each end of first header pipe 71, and a bracket member 76 fixed to each end of first header pipe 71. Bracket member 76 comprises a cap portion 78 and a rod portion 77. Cap portion 78 is formed over and is fixed to each end of first header pipe 71, and rod portion 77 extends vertically from cap portion 78. Similarly, each end of second header pipe 72 comprises disk-shaped plug member 75 positioned inside an opening formed in each end of second header pipe 72, and bracket member 76 fixed to each end of second header pipe 72. Bracket member 76 comprises cap portion 78 and rod portion 77. Cap portion 78 is formed over and is fixed to each end of second header pipe 72, and rod portion 77 extends vertically from cap portion 78. Moreover, a frame of a vehicle (not shown) may have a plurality of holes formed therethrough, such that each rod portion 77 may be inserted into a corresponding hole. As such, heat exchanger 70 may be fixed to the frame of the vehicle via rod portions 77. Nevertheless, bracket member 76 must be manufactured separately from first header pipe 71 and second header pipe 72, respectively, and subsequently must be fixed to the ends of first header pipe 71 and second header pipe 72, respectively. Consequently, the number of parts of heat exchanger 70 and the manufacturing cost of heat exchanger 70 may increase.

As disclosed in Japanese (Unexamined) Patent Publication No. HEI 11-83377, FIG. 3 depicts another known stacked-type, multi-flow heat exchanger. The heat exchanger comprises a first header pipe 71 and a second header pipe 72, and the ends of first header pipe 71 and second header pipe 72 are compressed or deformed to form a flattened plate portion 79. Flattened plate portion 79 has a substantially rectangular shape and a reduced thickness relative to a thickness of a center portion of first header pipe 71 and second header pipe 72, respectively. Nevertheless, the width or the diameter of flattened plate portion 79 is the same as the width or the diameter of first header pipe 71 and second header pipe 72, respectively. Flattened plate portion 79 also has a hole 80 formed therethrough. In this known heat exchanger, a frame of a vehicle (not shown) may have a plurality of threaded holes formed therethrough, such that a plurality of screws or a plurality of bolts may be used to fix the heat exchanger to the frame of the vehicle via holes 80 and the corresponding threaded holes. Nevertheless, because the ends of first header pipe 71 and second header pipe 72 originally were cylindrical shaped, and subsequently are compressed or deformed to form a substantially rectangular-shaped plate portion, the plate portion may become warped or twisted during the manufacturing process. Consequently, it may be difficult or impossible to fix the heat exchanger to the frame of the vehicle.

SUMMARY OF THE INVENTION

Therefore, a need has arisen for heat exchangers that overcome these and other shortcomings of the related art. A technical advantage of the present invention is that a stacked-type, multi-flow heat exchanger may be manufactured having fewer parts than known heat exchangers. Another technical advantage of the present invention is that the heat exchanger may more readily and accurately be fixed to a frame of a vehicle.

According to an embodiment of the present invention, a stacked-type, multi-flow heat exchanger is described. The heat exchanger comprises a first header pipe and a second header pipe formed opposite the first header pipe. The heat exchanger also comprises a plurality of beat transfer tubes extending between the first header pipe and the second header pipe, such that the first header pipe and the second header pipe are in fluid communication via the heat transfer tubes. The heat exchanger further comprises a plurality of fins alternately stacked with the plurality of heat transfer tubes. Moreover at least one of the ends, e.g., each of the ends, of the first header pipe comprises a first tapered portion having a reduced diameter relative to a diameter of a center portion of the first header pipe. In another embodiment, each of the ends of the second header pipe comprises a second tapered portion having a reduced diameter relative to a diameter of a center portion of the second header pipe.

According to yet another embodiment of the present invention, a method of manufacturing a stacked-type, multi-flow heat exchanger is described. The method comprises the step of compressing at least one end, e.g., each of the ends, of a first header pipe of a stacked-type, multi-flow heat exchanger to form a first tapered portion having a reduced diameter relative to a diameter of a center portion of the first header pipe. In still another embodiment, the method also comprises the step of compressing each of the ends of a second header pipe of the heat exchanger to form a second tapered portion having a reduced diameter relative to a diameter of a center portion of the second header pipe.

Other objects, features, and advantages will be apparent to persons of ordinary skill in the art in view of the following detailed description of the invention and the accompanying drawings.

BRIEF DESCRIPTION OF THE DRAWINGS

For a more complete understanding of the present invention, needs satisfied thereby, and the features and advantages thereof, reference now is made to the following descriptions taken in connection with the accompanying drawings.

DETAILED DESCRIPTION OF PREFERRED EMBODIMENTS

Preferred embodiments of the present invention and their advantages may be better understood by referring to FIGS. 4–11, like numerals being used for like corresponding parts in the various drawings.

Figure 1:
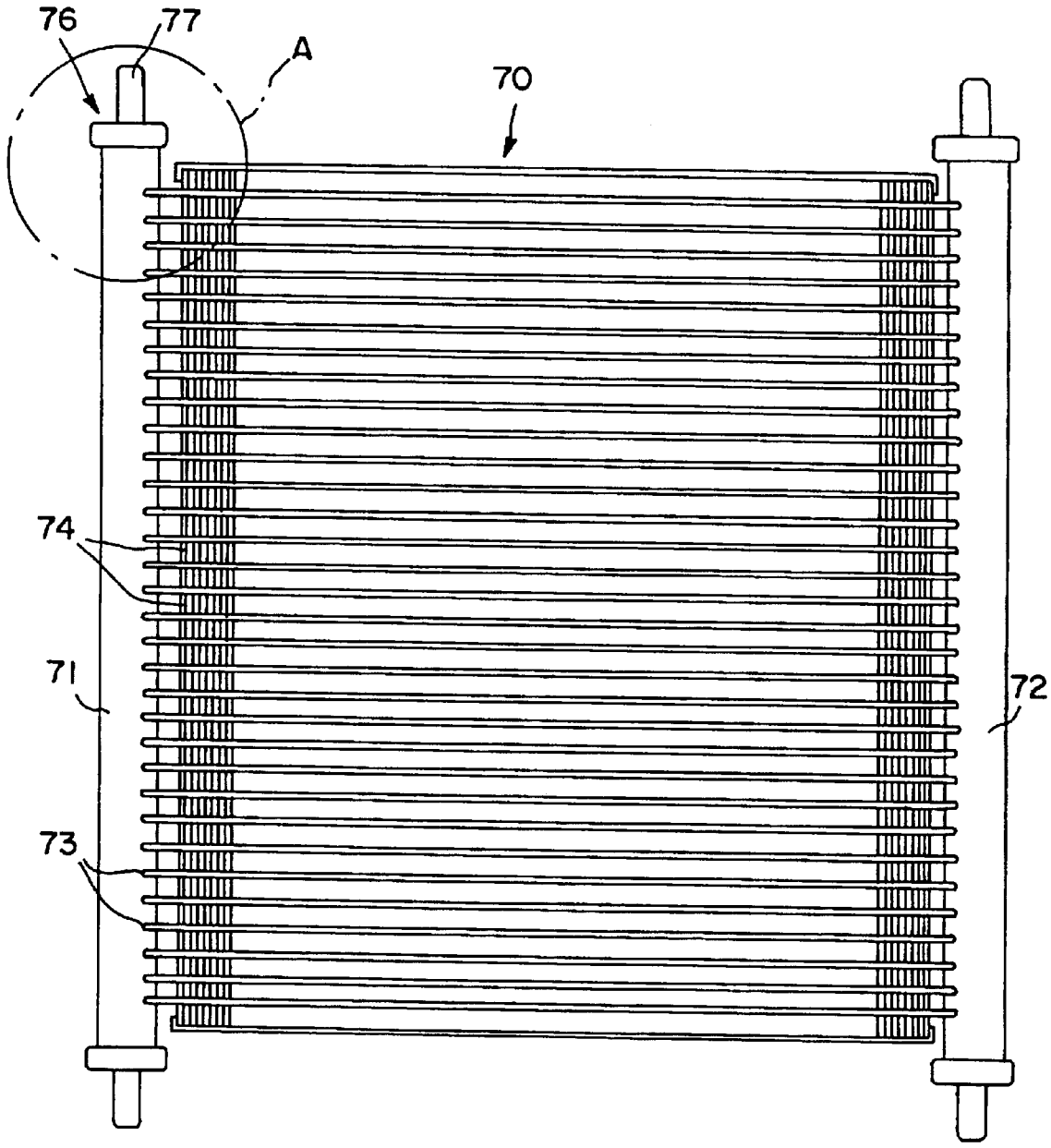
FIG. 1 PRIOR ART
FIG. 1 is a top view of a known stacked-type, multi-flow heat exchanger.
Figure 2:
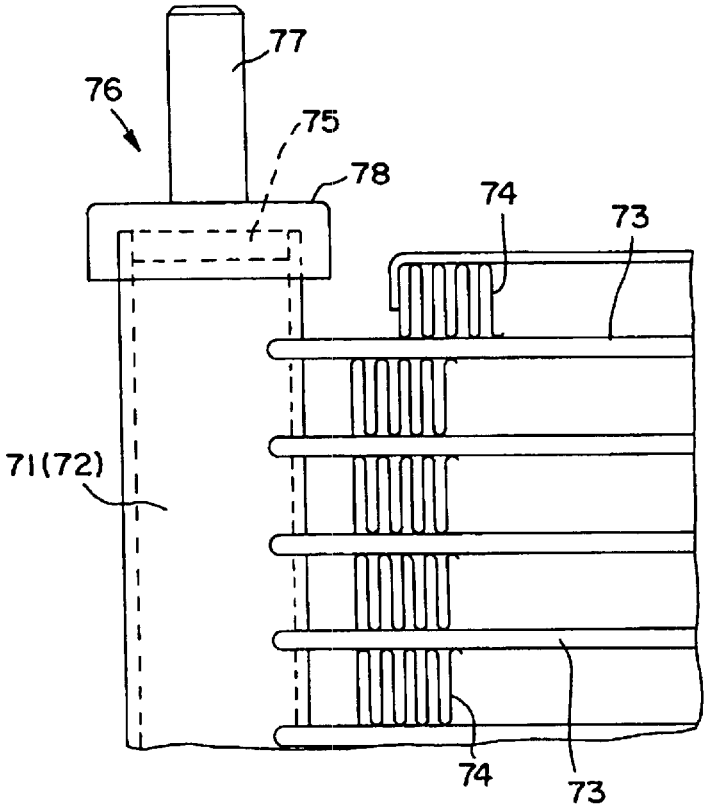
FIG. 2 PRIOR ART
FIG. 2 is an enlarged, cross-sectional view of a portion (A) of the heat exchanger of FIG. 1.
Figure 3:
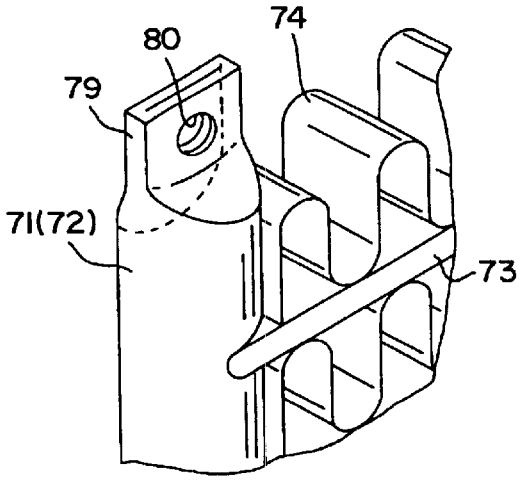
FIG. 3 PRIOR ART
FIG. 3 is an enlarged, perspective view of an end of a header pipe of another known stacked-type, multi-flow heat exchanger.
Figure 4:
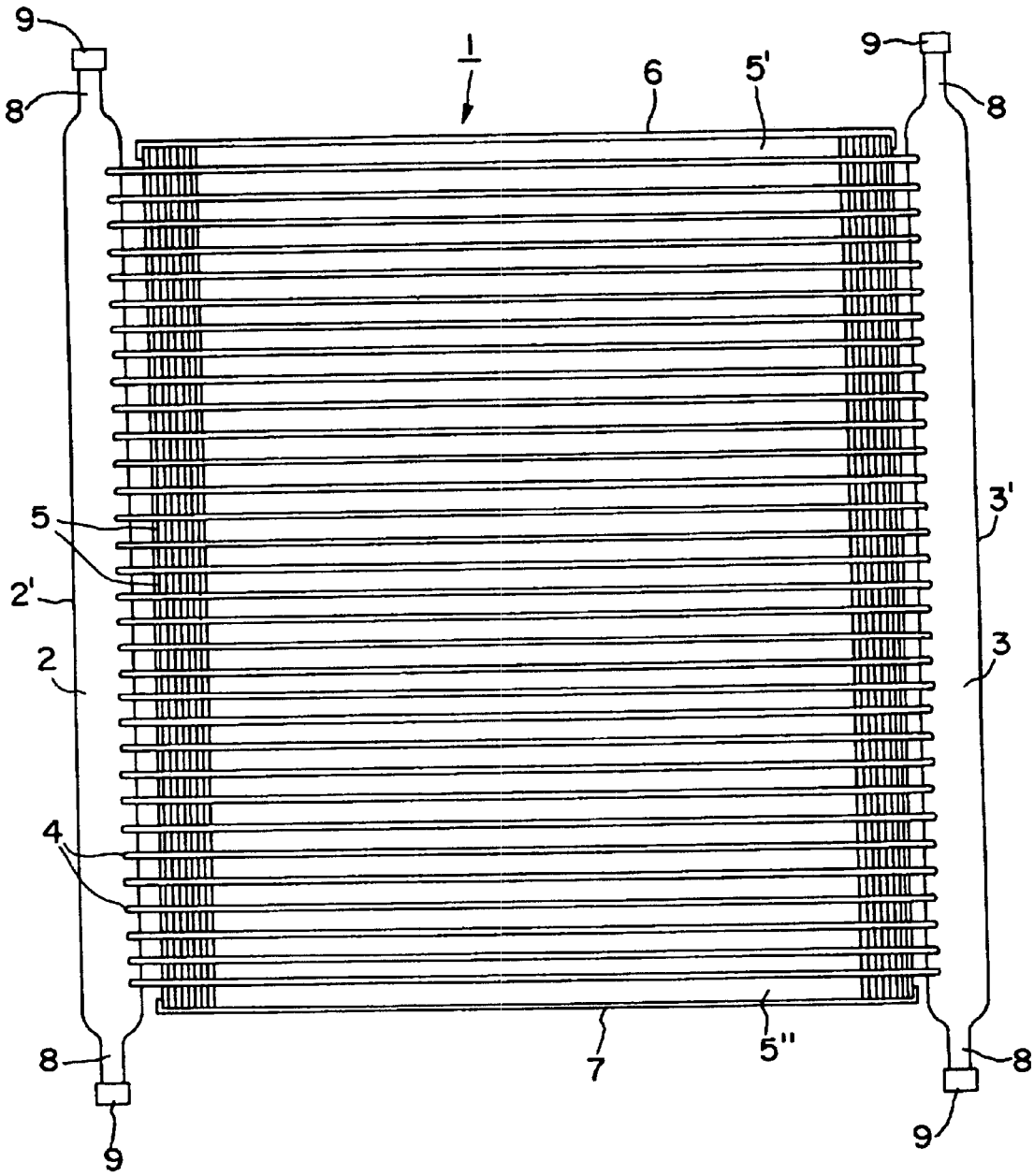
FIG. 4 is a top view of a stacked-type, multi-flow heat exchanger according to a first embodiment of the present invention.
Figure 5:
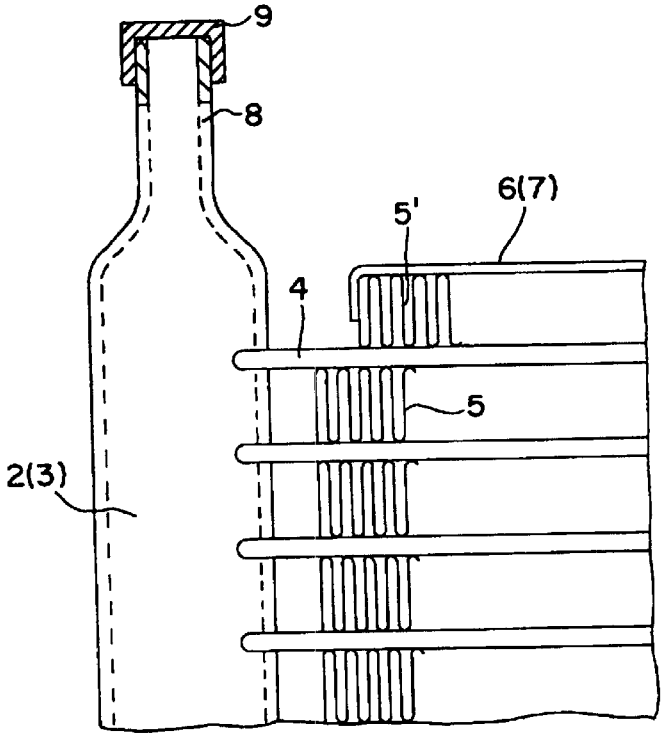
FIG. 5 is an enlarged, cross-sectional view of an end of a header pipe of the heat exchanger of FIG. 4.
Figure 6:
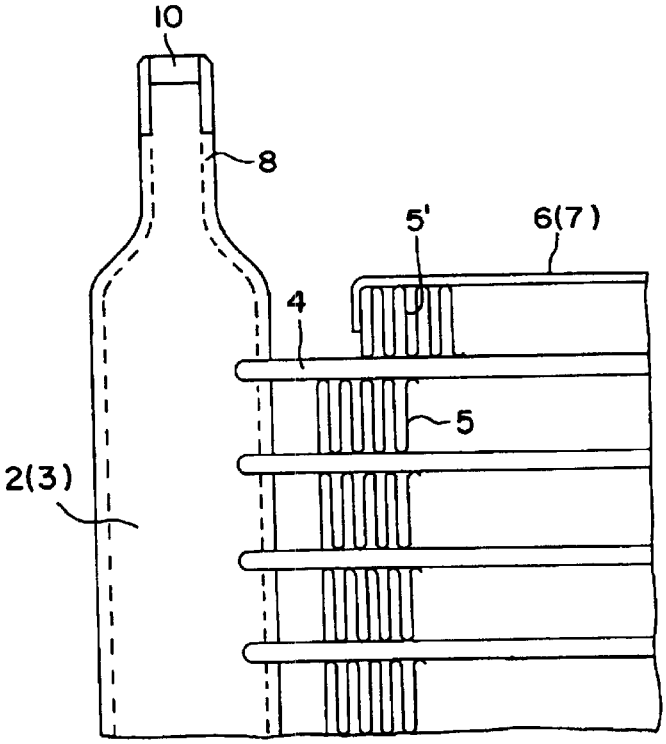
FIG. 6 is an enlarged, cross sectional view of the end of the header pipe of the heat exchanger of FIG. 4 depicting a modification of the first embodiment.
Figure 7:
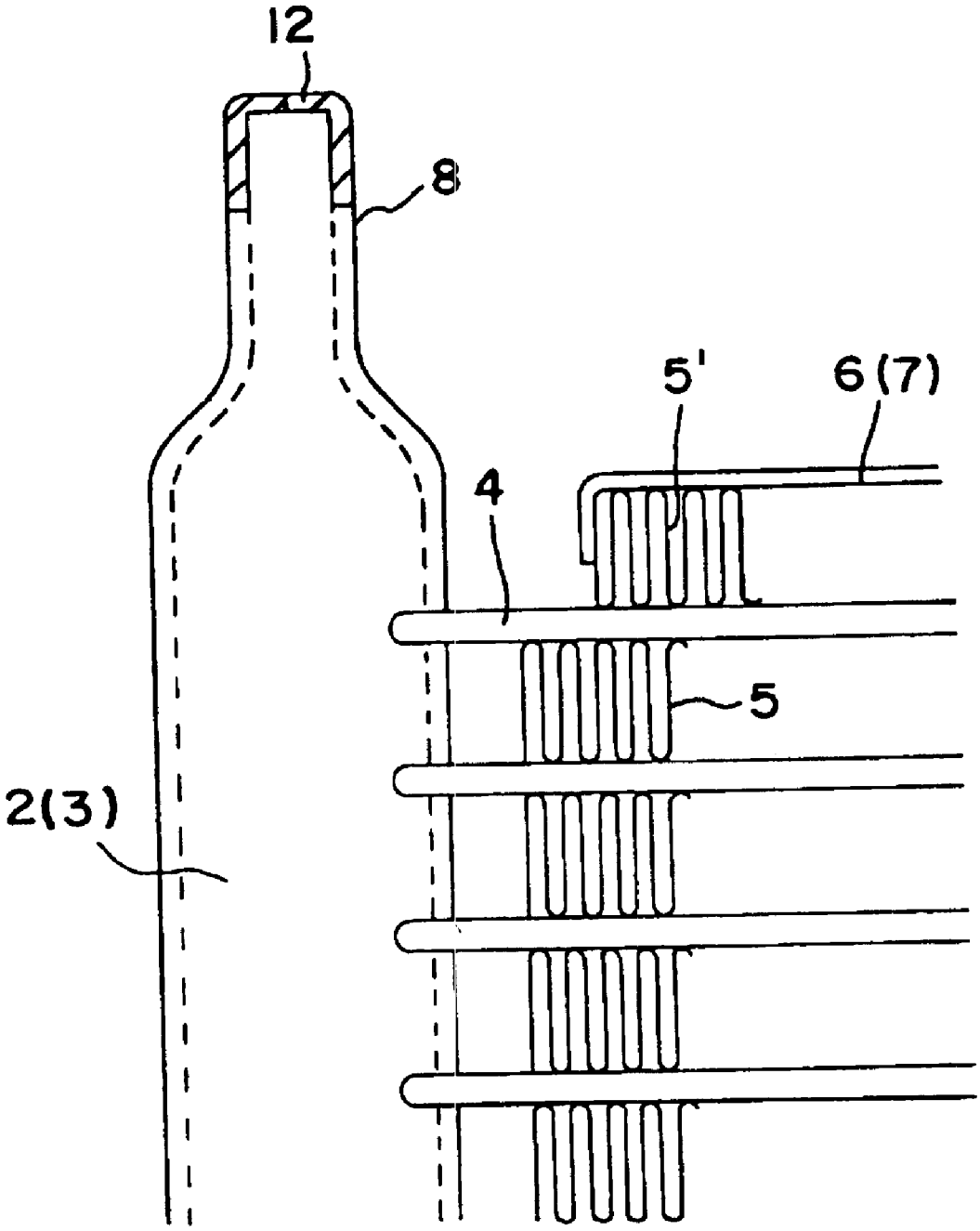
FIG. 7 is an enlarged, cross-sectional view of an end of a header pipe of a stacked-type, multi-flow heat exchanger according to a second embodiment of the present invention.
Figure 8C:
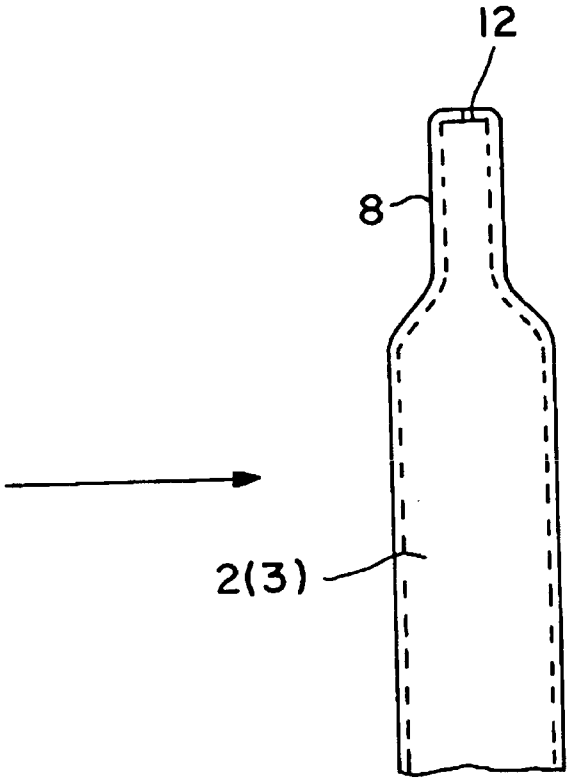
FIGS. 8*a*–8*c* are schematics depicting a method of manufacturing the end of the header pipe of the heat exchanger of FIG. 7.
Figure 8B:
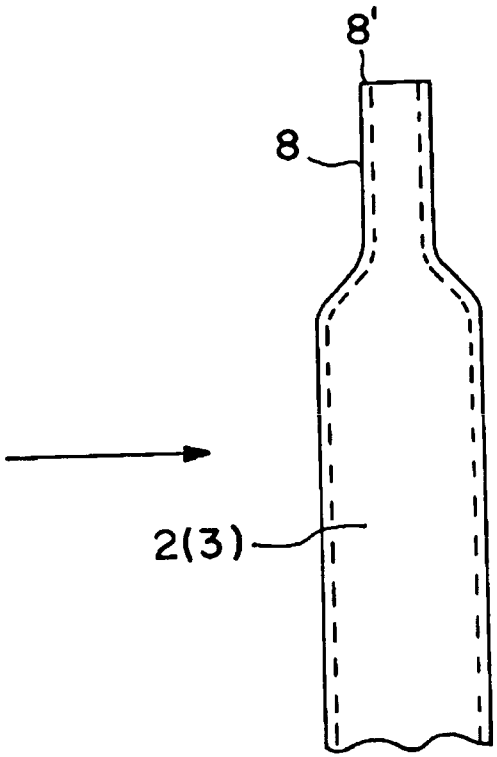
Figure 8A:
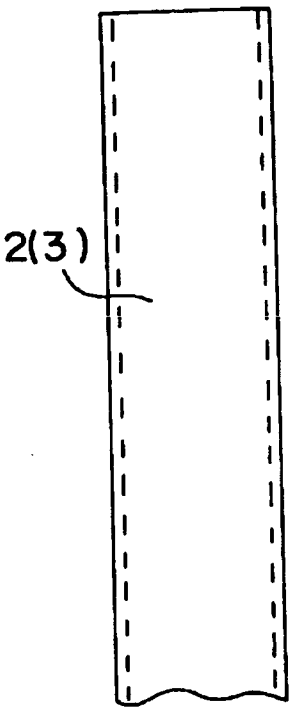

Referring to FIGS. 4–6, a heat exchanger 1 according to a first embodiment of the present invention is described. Heat exchanger 1 may comprise a first header pipe 2 and a second header pipe 3 formed opposite first header pipe 2. Heat exchanger 1 also may comprise a plurality of heat transfer tubes 4 extending between first header pipe 2 and second header pipe 3, such that first header pipe 2 and second header pipe 3 are in fluid communication via heat transfer tubes 4. Heat exchanger 1 further may comprise a plurality of corrugated fins 5 which are alternately stacked with heat transfer tubes 4. Heat exchanger 1 also may comprise a first side plate 6 and a second side plate 7 attached to the outermost fins 5' and 5", respectively. Moreover, an inlet pipe (not shown) may be connected to first header pipe 2, such that a refrigerant may be introduced into heat exchanger 1 via the inlet pipe. Similarly, an outlet pipe (not shown) may be connected to second header pipe 3, such that the refrigerant may be discharged from heat exchanger 1 via the outlet pipe.

Figure 11:
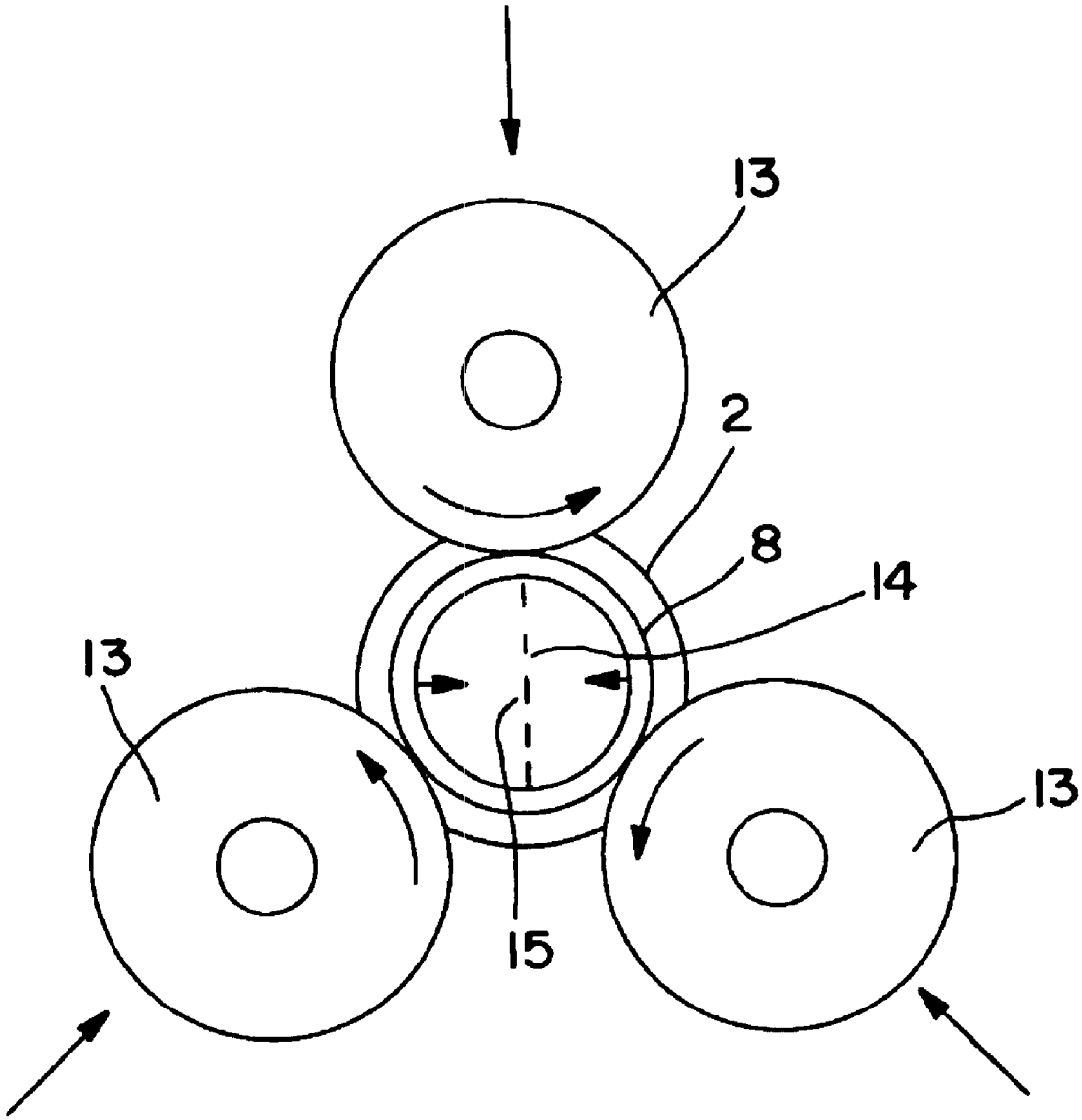
FIG. 11 is an enlarged, cross-sectional view of the end of the header pipe of the heat exchanger of FIG. 9, and a plurality of rollers for forming the end of the header pipe.

In heat exchanger 1, each end of first header pipe 2 may comprise a tapered portion 8 having a reduced diameter relative to a diameter of a center portion 2' of first header pipe 2. Similarly, each end of second header pipe 3 may comprise tapered portion 8 having a reduced diameter relative to a diameter of a center portion 3' of second header pipe 3. For example, tapered portion 8 may have a substantially cylindrical shape, and may be formed by compressing the ends of first header pipe 2 or second header pipe 3, or both, in the radial direction using a known pressing, swaging, or spinning method, or the like. An example of a known spinning method is depicted in FIG. 11. Moreover, a frame of a vehicle (not shown) may have a plurality of holes formed therethrough, such that each tapered portion 8 may be inserted into a corresponding hole. As such, heat exchanger 1 readily and accurately may be fixed to the frame of the vehicle via tapered portions 8 without using a separate bracket member. In this embodiment, heat exchanger 1 also may comprise a cap member 9. Cap member 9 may surround an opening formed within tapered portion 8, such that cap portion 9 may hermetically seal the opening formed within tapered portion 8. As shown in FIG. 6, in modification of this embodiment, cap member 9 may be replaced by a disk member 10. Disk member 10 may be inserted inside the opening formed within tapered portion 8, such that disk member 10 may hermetically seal the opening formed within tapered portion 8.

Referring to FIGS. 7 and 8*a*–8*c*, a heat exchanger 1 according to a second embodiment of the present invention is described. The features and advantages of this embodiment are substantially similar to those of the first embodiment. Therefore, the features and advantages of the first embodiment are not described further with respect to the second embodiment. In this embodiment, first header pipe 2 also may comprise an inward flange member 12 formed within the opening of tapered portion 8. Specifically, after tapered portion 8 is formed by compressing the ends of first header pipe 2, inward flange member 12 may be formed by angularly bending the circumferential edge of tapered portion 8 inward until flange member 12 hermetically seals the opening formed within tapered portion 8 of first header pipe 2. Similarly, second header pipe 3 also may comprise an inward flange member 12 formed within the opening of tapered portion 8. Specifically, inward flange member 12 may be formed by angularly bending the circumferential edge of tapered portion 8 inward until flange member 12 hermetically seals the opening formed within tapered portion 8 of second header pipe 3.

Figure 9:
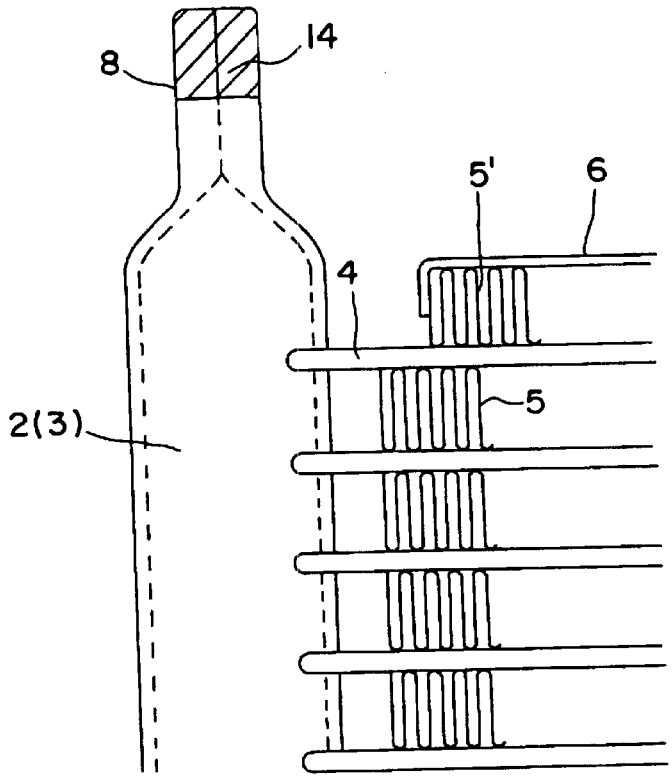
FIG. 9 is an enlarged, cross-sectional view of an end of a header pipe of a stacked-type, multi-flow heat exchanger according to a third embodiment of the present invention.
Figures 10A, 10B:
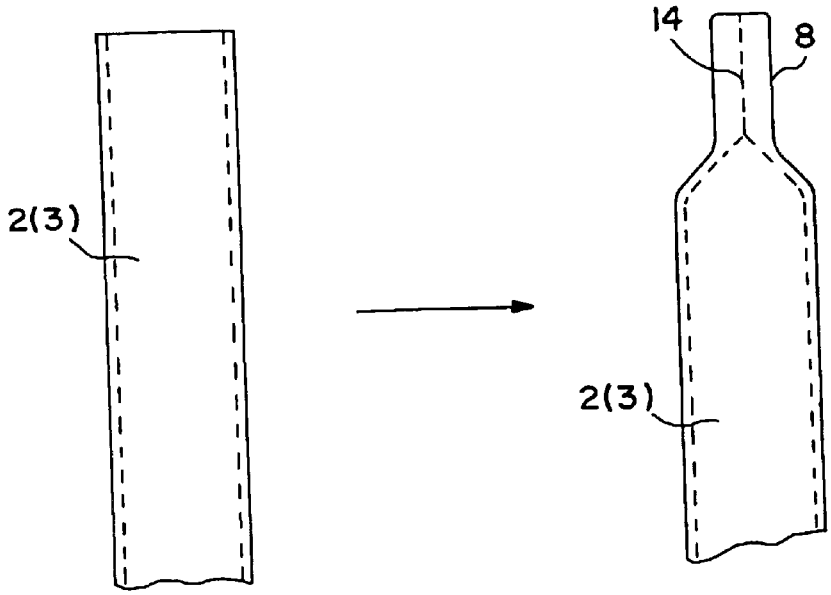
FIGS. 10*a*–10*b* are schematics depicting a method of manufacturing the end of the header pipe of the heat exchanger of FIG. 9.

Referring to FIGS. 9–11, a heat exchanger 1 according to a third embodiment of the present invention is described. The features and advantages of this embodiment are substantially similar to those of the foregoing embodiments. Therefore, the features and advantages of the forgoing embodiments are not described further with respect to the third embodiment. In this embodiment, each end of first header pipe 2 may comprise a tapered portion 8 having a reduced diameter relative to a diameter of a center portion 2' of first header pipe 2. Similarly, each end of second header pipe 3 may comprise tapered portion 8 having a reduced diameter relative to a diameter of a center portion 3' of second header pipe 3. For example, tapered portion 8 may have a substantially cylindrical shape, and may be formed by compressing the ends of first header pipe 2 or second header pipe 3, or both, in the radial direction using a known pressing, swaging, or spinning method, or the like.

Moreover, the diameter of tapered portion 8 may be reduced such that a first interior surface of tapered portion 8 contacts a second interior surface of tapered portion 8 along at least a portion of an axis 14, e.g., a center axis, of tapered portion 8. In one embodiment, the diameter of tapered portion 8 may be reduced such that the first interior surface of tapered portion 8 contacts the second interior surface of tapered portion 8 along the entire length of axis 14. When the first interior surface of tapered portion 8 contacts the second interior surface of tapered portion 8, the point or points of contact between the two surfaces may hermetically seal an opening 15 formed within tapered portion 8. When the first interior surface of tapered portion 8 contacts the second interior surface of tapered portion 8 along the entire length of axis 14, the diameter of opening 15 may approach zero or may be zero along the entire length of axis 14. For example, referring to FIGS. 10*a*, 10*b*, and 11, tapered portion 8 may be formed using a spinning method employing a plurality of rollers 13 to reduce the diameter of tapered portion 8, such that the first interior surface of tapered portion 8 contacts the second interior surface of tapered portion 8 along at least a portion of axis 14.

While the invention has been described in connection with preferred embodiments, it will be understood by those of ordinary skill in the art that other variations and modifications of the preferred embodiments described above may be made without departing from the scope of the invention. Other embodiments will be apparent to those of ordinary skill in the art from a consideration of the specification or practice of the invention disclosed herein.

What is claimed is:

1. A stacked-type, multi-flow heat exchanger comprising:

a first header pipe;

a second header pipe formed opposite said first header pipe;

a plurality of heat transfer tubes extending between said first header pipe and said second header pipe, wherein said first header pipe and said second header pipe are in fluid communication via said plurality of heat transfer tubes; and a plurality of fins alternately stacked with said plurality of heat transfer tubes, wherein at least one end of said first header pipe comprises a first tapered portion, and said first tapered portion is substantially cylindrical-shape, wherein said first tapered portion has a reduced diameter relative to a diameter of a center portion of said first header pipe, and an opening formed therethrough, wherein said diameter of said first tapered portion is selected, such that a first interior surface of said first tapered portion contacts a second interior surface of said first tapered portion along an axis of said first tapered portion, such that a diameter of said opening approaches zero or is zero and said interior surfaces of said first tapered portion hermetically seal said opening.

2. The heat exchanger of claim 1, wherein each end of said first header pipe comprises said first tapered portion having said reduced diameter relative to said diameter of said center portion of said first header pipe, and each end of said second header pipe comprises a second tapered portion having a reduced diameter relative to a diameter of a center portion of said second header pipe.

3. The heat exchanger of claim 2, wherein said diameter of each of said tapered portions is selected such that said first interior surface of said tapered portion contacts said second interior surface of said tapered portion along the entire length of said axis of said tapered portion, such that said diameter of said opening is about zero throughout said tapered portion and said interior surfaces of said tapered portion hermetically seal said opening.

* * * * *